United States Patent [19]

Pryor et al.

[11] 4,369,832

[45] Jan. 25, 1983

[54] CONTINUOUS LUBRICATION CASTING MOLDS

[75] Inventors: Michael J. Pryor, Woodbridge; Derek E. Tyler, Cheshire, both of Conn.

[73] Assignee: Olin Corporation, New Haven, Conn.

[21] Appl. No.: 249,761

[22] Filed: Apr. 1, 1981

Related U.S. Application Data

[62] Division of Ser. No. 84,768, Oct. 15, 1979.

[51] Int. Cl.[3] ..... B22D 11/07

[52] U.S. Cl. ..... 164/472; 164/485

[58] Field of Search ..... 164/472, 418, 138, 149, 164/268, 443, 485; 184/6.28

[56] References Cited

U.S. PATENT DOCUMENTS

| | | | |
|---|---|---|---|
| 2,747,244 | 5/1956 | Goss | 164/268 |
| 3,685,617 | 8/1972 | Gardner | 184/6.28 |
| 3,710,840 | 1/1973 | Fabens, Jr. | 164/421 X |

FOREIGN PATENT DOCUMENTS

| | | | |
|---|---|---|---|
| 1104124 | 4/1961 | Fed. Rep. of Germany | 164/472 |
| 1176139 | 1/1970 | United Kingdom | 164/472 |

*Primary Examiner*—Gus T. Hampilos
*Assistant Examiner*—K. Y. Lin
*Attorney, Agent, or Firm*—Barry L. Kelmachter; Howard M. Cohn; Paul Weinstein

[57] ABSTRACT

A continuous lubrication casting mold for use in a process of continuously casting molten metals and alloys wherein a parting and/or lubricating agent reservoir is provided in the mold body. The agent is continuously applied over the inner surface of the mold after being introduced through passages within or through the mold section. The lubricant passages may be an intrinsic characteristic of the mold material or may be provided in the form of feed holes through the mold section. The ability to transmit lubricant through to the internal surface of the mold can be varied within the length of the casting mold to provide for variable lubricant transfer rates to different parts of the casting surface.

7 Claims, 6 Drawing Figures

CONTINUOUS LUBRICATION CASTING MOLDS

This application is a division of application Ser. No. 84,768, filed Oct. 15, 1979.

BACKGROUND OF THE INVENTION

The invention relates to concepts and means for providing casting molds which permit effective heat transfer and effective lubrication over the total area of the casting mold.

Casting molds are used to shape molten metal and to extract heat from this metal to form a solid casting. These molds have two basic characteristics. The first is to extract heat to effect solidification, and the second is to provide a parting agent or lubricant to prevent adherence between the molten metal and the mold. The distribution of the parting agent or lubricant over the surface of the inner mold wall has a substantial effect on the surface quality of the solid casting, excessive amounts and concentrations of lubricant leading to pores in the surface of the casting and small amounts and concentrations of lubricant leading to a scaly casting surface.

In a continuous or semi-continuous casting the heat extraction is generally accomplished through use of water cooling on the back side of the mold liner. The cooling water is generally applied over the complete mold surface, but can also be circulated through channels machined in the body of the mold. The high thermal conductivity of the mold material provides for rapid extraction of heat from the whole internal area of the mold.

Lubrication in continuous or semi-continuous casting has been typically accomplished either by the use of mold washes or by other continuous means. The mold washes generally consist of oils or greases and contain parting agents such as graphite or other non-metallic particulate. They have a short life, and thus are generally used only in semi-continuous casting operations. The continuous lubrication means requires feeding lower viscosity oils to the molten metal meniscus. Accordingly, their effectiveness is restricted to this meniscus region. Such continuous systems have also been modified for use in hot top or closed mold casting where the lubricant is fed to the meniscus-mold region.

The above known lubrication techniques have obvious disadvantages in that they have limited life or provide lubrication only at the initial point of contact between the molten metal and the casting mold. It is well known that metal-mold contact also occurs in regions away from this initial point of contact. For instance, in the casting of long freezing range alloys the inverse segregation process provides for contact between the exuding segregate and the mold, towards the exit end of the casting mold. In such instances, which are numerous, the aforementioned lubrication techniques are clearly ineffective. Just as the heat extraction means afforded by the casting mold is generally accomplished over the full mold surface, there is also a need to provide lubrication over the total mold surface.

PRIOR ART STATEMENT

Various approaches have been taken in the prior art for attaining satisfactory lubrication of casting mold surfaces. One approach utilizes a supply of lubricant which is injected at the inlet end of the casting mold during the casting run. Variations of such an approach are depicted in French Pat. No. 1,050,375, U.S. Pat. Nos. 3,263,283, 4,057,100, 4,103,732, 4,157,728 and German Pat. No. 742,771.

The French Pat. No. '375 and the U.S. Pat. Nos. '283, '100 and '728 generally utilize either a series of lubricant injector passages or slits to inject lubricant into the mold cavity at the inlet end thereof, while U.S. Pat. No. '732 utilizes a lubricating ring which is rotatably held in a recess around the upper or inlet edge of the casting mold. The ring in the '732 patent is provided with a plurality of radially inwardly directed lubricant distribution channels. During casting the ring is rotated causing lubricant to flow around the entire periphery of the inlet end of the casting mold.

German Pat. No. 742,771 teaches supplying lubricant to an end portion of a casting mold. The lubricant is fed to the inner surface of the mold by passing it through a porous metal ring located at the end of the mold.

Another lubricating approach for continuous casting molds is depicted in U.S. Pat. No. 2,825,947. This patent is primarily directed to providing a layer of a substantially liquid refractory having a high fluidity between the molten metal miniscus and the mold wall, but further discloses a ring of lubrication parts arranged at the approximate midpoint of the casting mold.

In yet another approach to providing mold surface lubrication, British Pat. No. 1,176,139 discloses spraying the internal walls of a mold with a thin layer of metal particles welded together in a matrix. A series of lubricant passages is formed in the wall of the mold and supply lubricant to the particulate sprayed layer. The layer is penetrated through interstices between the layer particles forming a lubricant layer on the inner surface of the mold. Lubrication in this system, however, is intermittent due to carbonizing of the oil and consequent blockage of the interstices. Subsequent combustion of the carbon reopens the interstices.

In U.S. Pat. No. 3,451,465 a lubricant passage is shown at the inlet end of a casting mold. Lubricant in the passage penetrates into the mold casting chamber by capillary action through a porous member located adjacent to the passage and the chamber.

Finally, U.S. Pat. No. 4,044,817 teaches lubricating a casting mold by impregnating a liner with lubricant under a vacuum. The '817 patent is directed primarily to increasing the life of a graphite die or mold and notes that in some plainable manner lubrication of the cast metal interface is achieved. The graphite mold impregnation is carried out in a separate operation and is not carried out during continuous casting.

All of the aforementioned prior art patents suffer from at least two basic drawbacks. First, because the lubricant reservoir or source depends on severely limited numbers and/or geometric arrangements of lubricant supply passages, it becomes impossible to assure the desired supply along the entire length of the mold surface. Secondly, it would be highly desirable to be able to control the amount of lubricant supplied to selected portions along the length of the mold while still assuring sufficient lubrication along the entire mold length.

SUMMARY OF THE INVENTION

This invention relates to concepts and means for providing casting molds which permit effective heat transfer and effective lubrication over the total area of the casting mold, and more particularly to the provision of means for lubricant supply in preferred amounts over the full area of the casting mold. This is achieved by providing passages within or through the mold section through which the lubricant can be introduced.

The lubricant passages may be provided as an intrinsic characteristic of the mold material, as for example in a mold fabricated by powder metallurgy techniques wherein the continuous open pore fraction of the mold material provides the lubricant transmitting passages. As one alternative, the lubricant passages may be provided in the form of discrete feed holes which may be machined into a mold after initial fabrication or which may be incorporated into the mold during fabrication, as for example by the use of wires and the like during the pressing operation when utilizing the powder metallurgy fabrication route.

In another aspect of this invention, the permeability or ability of the mold to transmit lubricant through to the internal surface of the mold is varied within the length of the casting mold. This provides for variable lubricant transfer rates to different parts of the casting surface enabling lubricant flow to be focused in those regions of molten metal-mold or ingot shell-mold contact.

Accordingly, it is an object of this invention to provide an improved continuous lubrication casting mold and process which permits effective lubrication over the total area of the casting mold, and more particularly which provides for supplying lubricant at different desired transfer rates over the full area of the casting mold.

It is another object of the present invention to provide a continuous lubrication system and process which permits effective heat transfer to effect solification of a forming ingot shell within the casting mold.

This and other objects will become more apparent from the following description and drawings.

BRIEF DESCRIPTION OF THE DRAWINGS

Embodiments of the continuous casting mold according to this invention are shown in the drawings, wherein like numerals depict like parts.

DETAILED DESCRIPTION OF THE PREFERRED EMBODIMENTS

This invention discloses concepts and means for providing casting molds which provide improved and effective heat transfer and lubrication over the total area of the casting mold. The improved and effective heat transfer and lubrication is achieved by providing passages within or through the mold section through which lubricant can be introduced to the mold surface and by providing a lubricant source which runs along a substantial portion of the length of the mold.

One means for providing lubricant passages in accordance with this invention is to provide such passages as an intrinsic characteristic of the mold. This is readily achieved by fabricating the mold utilizing powder metallurgy techniques wherein the continuous open pore fraction present after sintering provides the routes for transmitting the lubricant to the casting face of the mold. This continuous open pore fraction is readily controlled within the powder metallurgy art by such means as control of powder particle size, distribution, compaction pressure, sintering cycle, etc. It furthermore can be supplemented by incorporation of particulate which is decomposable during the sintering cycle. Molds made by these techniques possess a characteristic permeability dependent upon the continuous open pore fraction and the mold thickness.

The term permeability as used herein defines the ability of the mold to transmit lubricant through to the internal surface of the mold.

Figure 1:
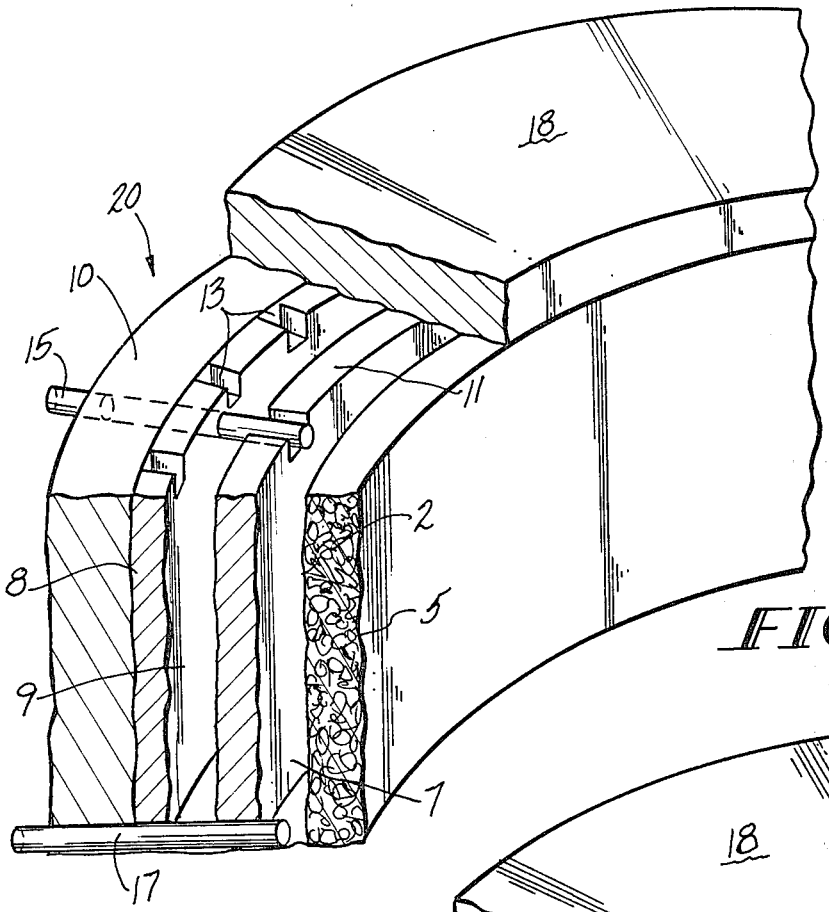
FIG. 1 is a partial section in accordance with this invention, showing a porous mold wall and a peripherally continuous lubricant plenum.

Referring to FIG. 1, there is shown therein a partial section of a mold in accordance with a first preferred embodiment of this invention. Casting mold 20 shown therein consists in part of a casting mold section 2 having a casting surface 5, a lubricant chamber or plenum 7, and a coolant chamber or plenum 9. Lubricant chamber or plenum 7 is formed by casting mold section 2 on one side and by lubricant chamber wall 11 on the other, and is supplied with lubricant via the lubricant supply conduit 15. Circulated lubricant is returned via return conduit 17. Coolant chamber or plenum 9 is formed on two sides by coolant wall 8 and chamber wall 11. Coolant jacket 10 is connected by plurality of coolant flow channels 13 formed in coolant wall 8 to coolant plenum 9, and supplies coolant via channels 13 to plenum 9. The entire mold wall structure is covered by the mold top plate 18.

As an alternative to providing circulation of lubricant in lubricant plenum 7, lubricant can be supplied to plenum 7 via a supply means such as supply conduit 15, but thereafter the lubricant can be retained at a desired pressure rather than being circulated. In such a case return conduit 17 is maintained closed or is not provided.

As can be seen from FIG. 1, lubricant may be provided to the permeable casting mold 2 via lubricant chamber or plenum 7 which covers the total outer surface of casting mold section 2. This lubricant chamber or plenum 7 is backed by the second chamber or plenum 9 which contains the coolant, typically water. The wall between these two chambers, in this case lubricant chamber wall 11, should be solid sections of a high conductivity metal such as copper or aluminum.

In the embodiment of FIG. 1 the water or other coolant used provides the primary means for extracting heat and solidifying an ingot shell. This water can thereafter be deflected onto the emerging ingot and be used to complete the solidification process. One of the primary benefits of the mold arrangement in accordance with this invention is that unlike other known prior art casting molds the lubricant in casting mold 20 assists in this heat transfer process along substantially the entire length of the casting mold which effects solidification of the ingot shell by filling the gap formed by shrinkage between the mold and the forming ingot with lubricant.

Another significant benefit of the casting mold 20 in accordance with the present invention is the ability of the lubricant supply system of mold 20 to supply lubricant to substantially the entire casting surface 5 quickly, continuously and efficiently, and in amounts and locations desired, as a partial result of utilizing a lubricant chamber or plenum 7 running continuously around the periphery of and substantially along the entire length of porous casting mold section 2.

Figure 2:
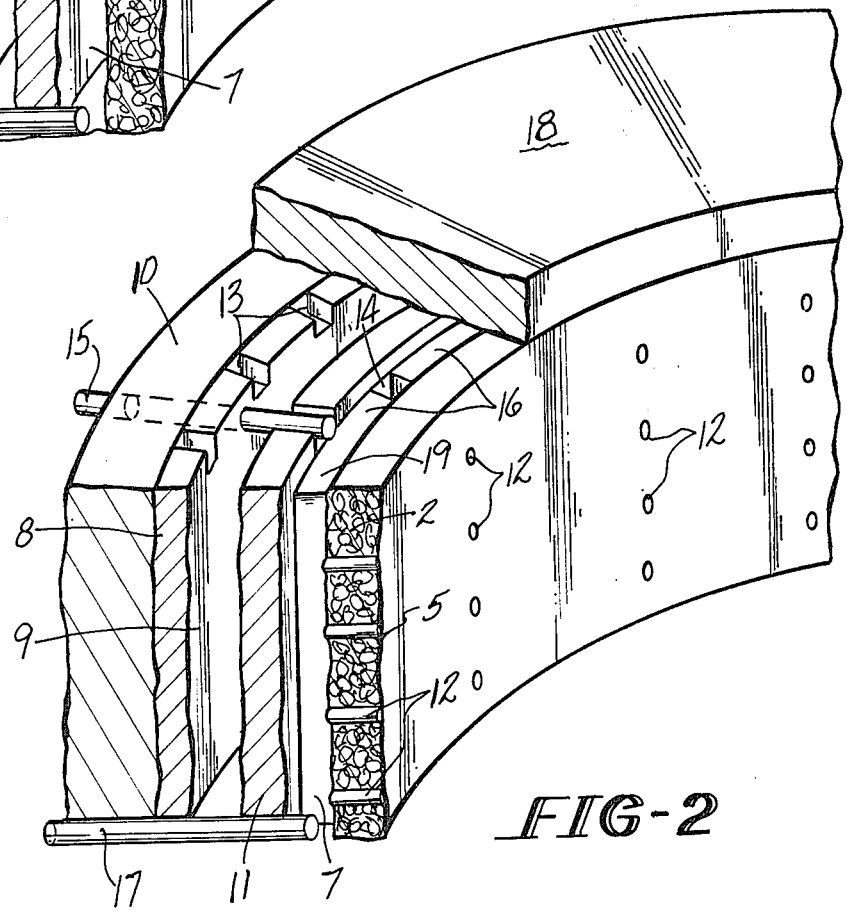
FIG. 2 is a view similar to FIG. 1 of a mold in accordance with another embodiment of this invention, showing a porous mold wall having a plurality of distinct uniform cross-section lubricating passages therein, and further showing a substantially full height lubricant plenum having distinct lubricant supply channels along the length thereof.

It is also envisaged that the intrinsic permeability of the casting mold section 2 can be supplemented by provision of discrete parallel-sided or cylindrical feed holes 12, as depicted in FIG. 2. Such holes can be machined into the mold before or after the sintering operation, or can be incorporated during the pressing operation by use of wires, fibers or other suitable media. Use of wires which are non-compressable provide for retention of good geometrical control of these passages during the pressing operation; such wires would be withdrawn from the "green" body prior to sintering. Alternatively, use of organic fibers which are decomposable during sintering may facilitate fabrication. The lubrication passages formed by these techniques may be geometrically arranged at will to supply lubricant to those regions of the mold wall where contact with the molten metal or solidifying ingot shell is found to be most troublesome.

In the case of the FIG. 2 embodiment of the present invention, lubricant plenum 7 has been provided with a series of peripheral vertical ribs 16 which form a series of vertical channels 14. Lubricant plenum 7 in this embodiment is provided with a main header 19 which runs around the mold periphery. Lubricant is supplied to main header 19 and is then fed to the vertical channels 14 which run down the length of the casting mold 20 and casting mold section 2. While this lubricant plenum design can be utilized to feed lubricant to a porous casting mold section 2, as shown in FIG. 1, it is particularly suitable where lubricant is to be fed to the casting mold section surface via discrete holes, in which case the vertical feed channels would provide lubricant directly into the pattern of discrete holes.

Figure 3:
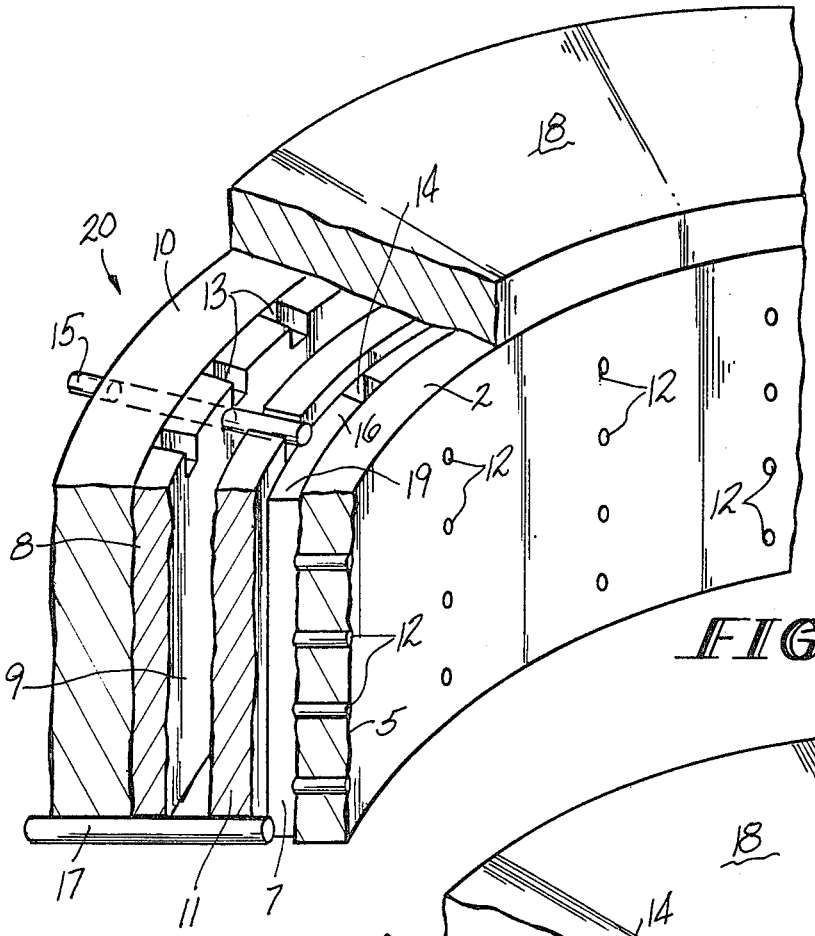
FIG. 3 is a view similar to FIGS. 1 and 2 of a mold in accordance with another embodiment of this invention, showing a solid mold wall having a plurality of distinct uniform cross-section lubricating passages therein and further showing a full height lubricant plenum having distinct lubricant supply channels along the length thereof.

FIG. 3 shows an embodiment wherein a channelled lubricant plenum is utilized to feed lubricant to the surface 5 of a solid casting mold section 2'.

The concept of utilizing a channelled lubricant plenum wherein the channels run substantially the entire length of the casting mold section provides the same cooling benefit as discussed hereinabove with respect to the continuous lubricant plenum depicted in FIG. 1. It should also be emphasized that such a channelled lubricant plenum is equally applicable when using any porous mold absent feed holes 12, inasmuch as the intrinsic permeability of the mold serves to disperse the lubricant as it flows through the mold. In other words, greater coverage is achieved on the inner mold surface even through the lubricant emanates from a narrow feed channel. Thus, the feed channels must be spaced so as to provide lubrication over the full inner mold surface. As described above, this lubrication mode with discrete feed channels rather than a full plenum can also be backed by a water cooling plenum.

Figure 4:
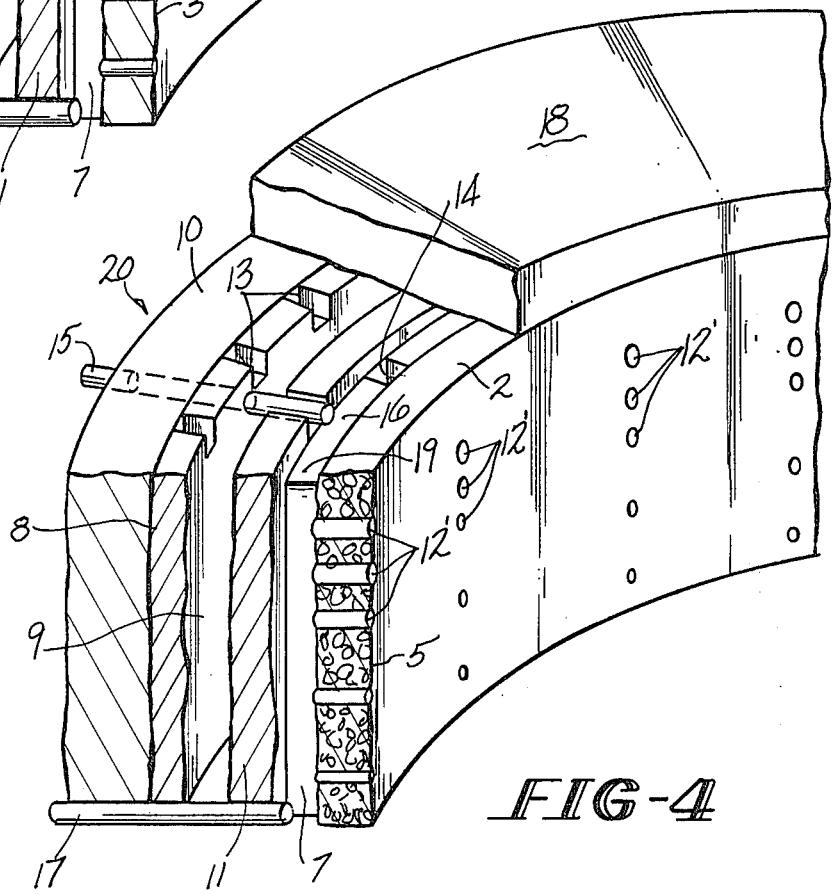
FIG. 4 is a view similar to FIGS. 1 through 3 of a mold in accordance with another embodiment of this invention, showing a porous mold wall having a plurality of distinct uniform cross-section lubricating passages of varying sizes therethrough.

Another embodiment for controlling the amount of lubricant directed to selected areas of inner mold casting surface 5 is depicted in FIG. 4. The feed holes 12' are shown therein to be of varying cross-sectional dimension in traveling the length of the casting mold section 2, i.e. the feed holes 12' are largest at the top portion of mold section 2, and get progressively smaller in traveling down toward the bottom of mold section 2. It should be apparent that the number, geometrical placing, density, and cross-sectional dimensions of feed holes 12' can be arranged as desired to provide added supply of lubricant to critical areas of casting surface 5 of mold section 2. FIG. 4 depicts an embodiment where larger amounts of lubrication are supplied to the upper area of casting mold 20 to overcome the effect of the vaporizing of lubricant as a result of contact with the hot molten metal as it is initially brought into contact with casting surface 5.

As stated hereinabove, molds manufactured via the powder metallurgy route possess a continuous open pore fraction that provides the routes for transmitting the lubricant to the casting face of the mold. Molds made by this process possess a characteristic permeability dependent upon the continuous open pore fraction and the mold thickness. It is this permeability which significantly determines the rate lubricant can be transferred through to the internal surface of the mold.

Figure 5:
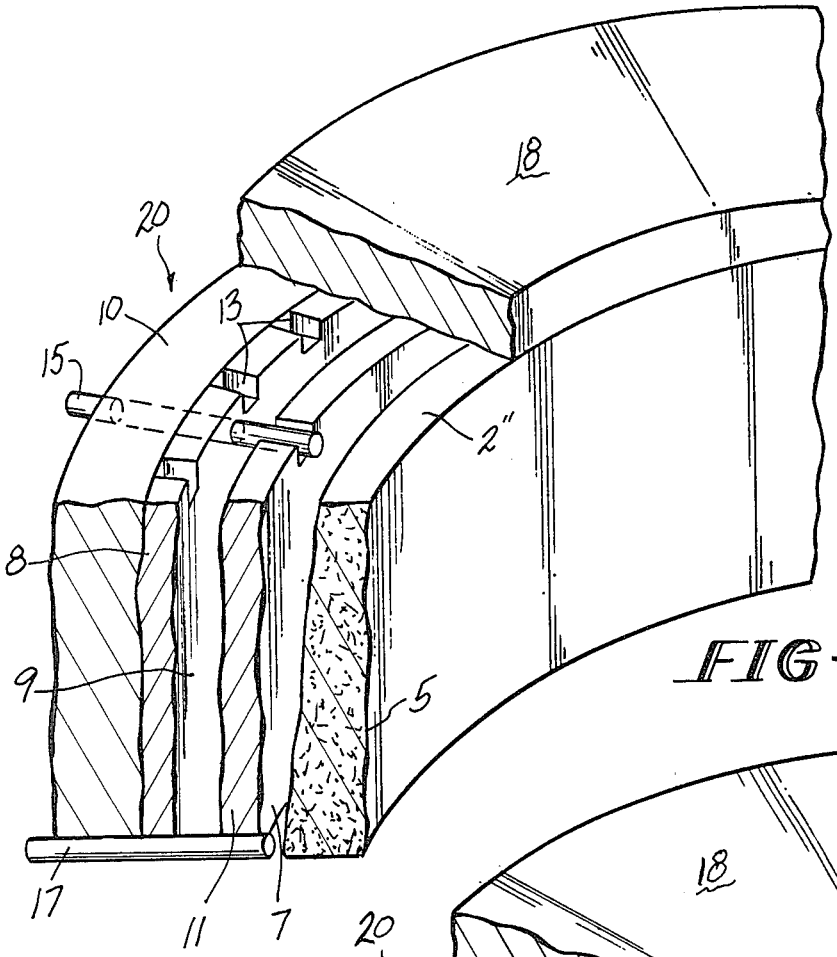
FIG. 5 is a view similar to FIGS. 1 through 4 of a mold in accordance with another embodiment of this invention, showing a porous mold wall having a non-uniform tapered cross-section.

FIG. 5 depicts a preferred embodment of this invention wherein the rate lubricant can be transferred through to the internal surface of mold section 2'' is varied by varying the thickness of casting mold section 2'' along the length thereof, the rate being lower as it gets thicker, or in the case of FIG. 5, in traveling down the length of the casting mold 20.

Figure 6:
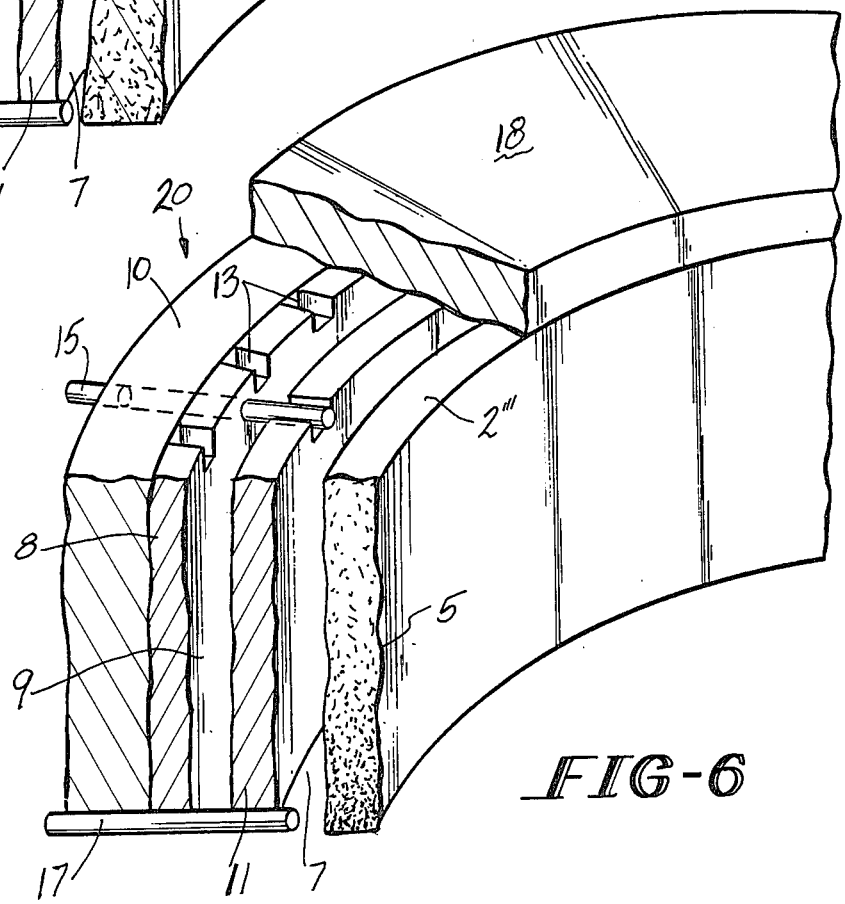
FIG. 6 is a view similar to FIGS. 1 through 5 of a mold in accordance with yet another embodiment of this invention, showing a porous mold wall having a non-uniform particle density or porosity along the length thereof.

FIG. 6 shows yet another preferred embodiment in accordance with this invention for varying the continuous open pore fraction and thus the permeability of casting mold section 2''' along substantially the entire length thereof. As can be seen from FIG. 6, the castng mold section 2''' has an open pore fraction which decreases in traveling downwardly along the length of casting mold 20. The permeability of casting mold section 2''' thus diminishes in traveling in this direction along casting surface 5 of casting mold section 2'''. As discussed hereinabove, the continuous open pore fraction is readily controlled within the powder metallurgy art by such means as powder particle size, distribution, compaction pressure, sintering cycle, etc. It furthermore can be supplemented by incorporation of particulate which is decomposable during the sintering cycle.

Accordingly, within the teachings of this invention it is clear that the permeability can be changed within the length of the casting mold to provide for variable lubricant transfer rates to different parts of the casting surface. By this means, lubricant flow can be focused in those regions of molten metal-mold or ingot shell-mold contact or other regions as desired.

It has been found that lubricant flow rate through the permeable casting mold section are desirably in the range of about 0.1 to 10 cc/in$^2$/min, with a preferred rate in the range of about 0.5 to 5 cc/in$^2$/min.

While the permeability is substantially dependent upon the viscosity and temperature of the lubricant selected, where the lubricant is substantially continuously circulated through the lubricant plenum a pressure drop across the mold section from the lubricant plenum side to the casting side thereof in the range of about 0.01 to 5 psi is normally desirable, with a preferred pressure drop being in the range of about 0.1 to 1 psi. In the embodiment where the lubricant is not circulated through the plenum, it is desirable to maintain lubricant in the plenum at a pressure in the range of about 1 to 100 psi, and preferably in the range of about 5 to 50 psi.

It is envisaged that this invention can be used for casting all metals and alloys. Selection of the mold material, mold permeability, lubricant, etc. will be dependent upon the particular alloy or metal being cast. Accordingly, the mold material may be selected from copper, aluminum, or other metals and alloys, graphite, boron nitride or other thermally conductive materials. The lubricant may be selected from castor oil, rapeseed oil, other vegetable or animal oils, esters, paraffins, other synthetic liquids, and any other suitable lubricants typically utilized in the casting arts.

It is apparent that there has been provided with this invention a novel process and continuous lubrication casting apparatus for continuously casting molten metals and alloys which fully satisfy the objects, means and advantages set forth herein before. While the invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. A process for continuously casting molten metals or alloys comprising:

providing a continuous lubrication casting mold, said casting mold including a permeable casting mold section defining an inner casting surface, an outer lubricant receiving surface extending over substantially the entire length of said casting mold section, a molten metal or alloy inlet end, and an outlet end, said casting mold section comprising a porous body having a continuous open pore fraction associated therewith for establishing a set of passages for a lubricant, said open pore fraction varying along the length of said casting mold so that said open pore fraction is greater at said inlet end than at said outlet end;

passing said molten metal or alloy through said casting mold section; and supplying said lubricant to said outer surface so that said lubricant passes through said first passages in said variable open pore fraction porous body and transfers onto said inner surface in a non-uniform manner along substantially the entire length thereof.

2. A process for continuously casting molten metals or alloys comprising:

providing a continuous lubrication casting mold, said casting mold including a permeable casting mold section defining an inner casting surface and an outer lubricant receiving surface extending over substantially the entire length of said casting mold section, a molten metal or alloy inlet end and an outlet end, said casting mold section comprising a porous body having a continuous open pore fraction associated therewith for establishing a set of passages for a lubricant and a variable thickness along its length, said thickness being greater at said outlet end than at said inlet end;

passing said molten metal or alloy through said casting mold section; and supplying said lubricant to said outer surface so that said lubricant passes through said first passages in said variable thickness porous body and transfers onto substantially the entire length of said inner surface and at a rate greater adjacent said inlet end than adjacent said outlet end.

3. The process of any one of claims 1 or 2 further comprising:

providing a plurality of discrete feed holes extending between said inner and outer surfaces; and said step of supplying lubricant further comprising passing additional lubricant through said feed holes onto said inner surface.

4. A process as recited in any one of claims 1 or 2 wherein said step of supplying said lubricant includes the steps of forming a substantially continuous peripheral lubricant chamber along substantially the entire length of and adjacent said permeable casting mold section, and maintaining a continuous supply of said lubricant in said chamber.

5. A process as recited in any one of claims 1 or 2 wherein said step of supplying lubricant further includes supplying different amounts of said lubricant to different portions of said inner casting surface so that selected portions of said inner casting surface receive a different amount of said lubricant than other portions of said inner casting surface.

6. A process as recited in claim 4 wherein said continuous supply of lubricant is maintained in said chamber while simultaneously continuously circulating said lubricant through said chamber.

7. A process as recited in claim 6 including the step of maintaining a pressure drop across said casting mold section from the chamber side of said casting mold section to the inner casting surface side of said casting mold section.

* * * * *

UNITED STATES PATENT AND TRADEMARK OFFICE

CERTIFICATE OF CORRECTION

PATENT NO. : 4,369,832

DATED : January 25, 1983

INVENTOR(S) : Michael J. Pryor et al.

It is certified that error appears in the above-identified patent and that said Letters Patent is hereby corrected as shown below:

In column 3, line 36, change "This" to ---These---.

In column 6, line 3, change "through" to ---though---;

In column 6, line 37, change "embodment" to ---embodiment---;

In column 6, line 48, change "castng" to ---casting---;

In column 6, line 67, change "rate" to ---rates---.

In column 7, line 31, change "herein before" to ---hereinbefore---;

In column 7, line 58, delete "first".

In column 8, line 23, delete "first";

In column 8, lines 28-34, delete claim 3.

On the title page "7 Claims" should read --6 Claims--.

Signed and Sealed this

*Twenty-first* Day of *August 1984*

[SEAL]

*Attest:*

*Attesting Officer*

GERALD J. MOSSINGHOFF

*Commissioner of Patents and Trademarks*